US005584747A

United States Patent [19]

Ikeda et al.

[11] Patent Number: 5,584,747

[45] Date of Patent: Dec. 17, 1996

[54] SHOT BLASTING APPARATUS FOR POLISHING AND CLEANING WHEEL

[75] Inventors: Susum Ikeda, Aichi-ken; Kyoichi Suzuki, Shinshiro; Sinri Inoue, Toyokawa, all of Japan

[73] Assignee: Sintokogio Ltd., Nagoya, Japan

[21] Appl. No.: 384,436

[22] Filed: Feb. 2, 1995

Related U.S. Application Data

[63] Continuation of Ser. No. 91,596, Jul. 15, 1993, abandoned.

[30] Foreign Application Priority Data

Jul. 24, 1992 [JP] Japan ..... 4-057790 U

[51] Int. Cl.[6] ..... B24C 3/10

[52] U.S. Cl. ..... 451/83; 15/3; 15/268; 134/123; 134/134; 198/373; 198/463.5; 221/277; 414/746.3; 414/746.4; 414/746.7; 451/89; 451/331

[58] Field of Search ..... 221/192, 227; 198/373, 463.5; 414/746.3, 746.4, 746.7; 451/331, 332, 83, 336, 76, 89; 15/3, 88, 268; 134/123, 134

[56] References Cited

U.S. PATENT DOCUMENTS

| | | | |
|---|---|---|---|
| 748,545 | 12/1903 | Troehler | 134/134 X |
| 2,131,769 | 10/1938 | Turnbull | 51/420 X |
| 2,343,357 | 3/1944 | Zimmerman | 51/420 X |
| 2,692,458 | 10/1954 | Lawrence | 51/420 X |

FOREIGN PATENT DOCUMENTS

| | | | |
|---|---|---|---|
| 175569 | 9/1906 | Germany | 134/134 |
| 0074252 | 5/1982 | Japan | 134/123 |
| 59-3801 | 2/1984 | Japan . | |
| 436493 | 10/1935 | United Kingdom | 51/420 |

*Primary Examiner*—Joseph M. Gorski
*Attorney, Agent, or Firm*—Nikaido, Marmelstein, Murray & Oram LLP

[57] ABSTRACT

An aluminum wheel having a side on which an annular groove is formed is stably led to a polishing and cleaning station in a compact shot blasting apparatus in which the aluminum wheel is uniformly polished and cleaned, and in which an inlet guide way and an outlet guide way on which the aluminum wheel rolls are provided upstream and downstream of a pair of eccentric rollers, a stopper is provided above the inlet guide way while a kick-out bracket which can ascend and descend passing through a gap between the eccentric rollers is provided so that the aluminum wheel is led onto the eccentric rollers with its rolling speed being controlled by the stopper and the kick-out bracket. Further, the shot blasting zone on the aluminum wheel is extended horizontally in a band-like shape.

10 Claims, 5 Drawing Sheets

SHOT BLASTING APPARATUS FOR POLISHING AND CLEANING WHEEL

This application is a continuation of application Ser. No. 08/091,596 filed Jul. 15, 1993 and now abandoned.

BACKGROUND OF THE INVENTION

The present invention relates to a shot blasting apparatus for subjecting a wheel to peening or matte-finishing, and in particular to a shot blasting apparatus for polishing and cleaning a wheel formed at its rotating side with an annular groove surrounding the axis of the wheel as a rotating center.

PRIOR ART

Heretofore, a shot blasting apparatus for polishing and cleaning a wheel such as that disclosed in Japanese Utility Model Publication No. 59-3801 has been known. In this apparatus, a wheel is set on a pair of eccentric rollers which are rotated in a one-way direction, being synchronized with each other, and accordingly, the wheel is rotated and revolved in a vertical plane while shots are blasted onto a rotating side thereof. This apparatus has an advantage that it tan be made to be compact.

However, the above-mentioned shot blasting apparatus has a disadvantage. That is, it is very difficult to stably set the wheel on a pair of eccentric rollers in a polishing and cleaning chamber in the apparatus due to its inertia after the wheel is rolled on an inlet guide way led to the pair of eccentric rollers, and in the worst case, the wheel falls down.

Further, In the above-mentioned apparatus, a shot ejecting wheel in a centrifugal shot ejector is vertically rotated so that the zone onto which shots are blasted is band-like, extending vertically. With the use of this apparatus for polishing and cleaning a wheel having an annular groove which is formed at its rotating side around the axis of the wheel as a rotating center, as shown in FIGS. 9 and 10, many shots remain in the lower part of the annular groove, which hinder shot ejected thereafter from polishing and cleaning the innermost part of the annular groove. As a result, there has been raised a problem of non-uniform finishing.

SUMMARY OF THE INVENTION

The present invention is devised in view of the above-mentioned disadvantages, and accordingly a first object of the present invention is to provide a shot blasting apparatus for polishing and cleaning a wheel, incorporating a guide mechanism which can set a wheel, stably, on the pair of eccentric rollers in a polishing and cleaning chamber in the shot blasting apparatus with no risk of falling down of the wheel after the wheel is rolled on an inlet guide way led to the pair of eccentric rollers.

Further, a second object of the present invention is to provide a shot blasting apparatus with which a uniform polishing and cleaning result can be obtained even though a wheel has an annular groove formed at a rotating side of the wheel.

To the end according to the present invention, there is provided a shot blasting apparatus for polishing and cleaning a wheel, comprising a polishing and cleaning chamber including a closable inlet opening for introducing a wheel to be polished and cleaned, and a closable outlet opening for delivering a polished and cleaned wheel; first and second eccentric rollers incorporated in said polishing and cleaning chamber and adapted to be rotated, for rotating and revolving the wheel set thereon in a vertical plane, said first and second eccentric rollers being arranged so as to define a gap therebetween; a transfer path means including an inlet guide way along which the wheel to be polished and cleaned, rolls from said inlet opening to said first eccentric roller, and an outlet guide way along which the polished and cleaned wheel rolls from said second eccentric roller to said outlet opening; a centrifugal shot ejecting means incorporated in said polishing and cleaning chamber, for ejecting shots onto the wheel set on said first and second eccentric rollers; a retractable stopper means adapted to approach said inlet guide way so as to engage with said wheel to be polished and cleaned in order to stop said wheel on said inlet guide way, and then adapted to go away from said inlet guide way so as to release said wheel in order to allow said wheel to roll; and a bracket means adapted to be ascend and descend through said gap between said first and second eccentric rollers, said bracket means engaging with said wheel to be polished and cleaned, in order to stop said wheel on said first eccentric roller when it ascends, and then releasing said wheel so as to allow said wheel to roll in order to set said wheel on said first and second eccentric rollers when it descends, and said bracket means kicking out said polished and cleaned wheel set on said first and second eccentric rollers so as to allow said wheel to roll on said outlet guide way when said bracket means ascends again.

BRIEF DESCRIPTION OF THE DRAWINGS

These and other objects, advantages and features of the present invention will become more apparent in the following description of preferred embodiments with reference to the drawings in which.

DETAILED DESCRIPTION OF PREFERRED EMBODIMENTS

Figure 1:
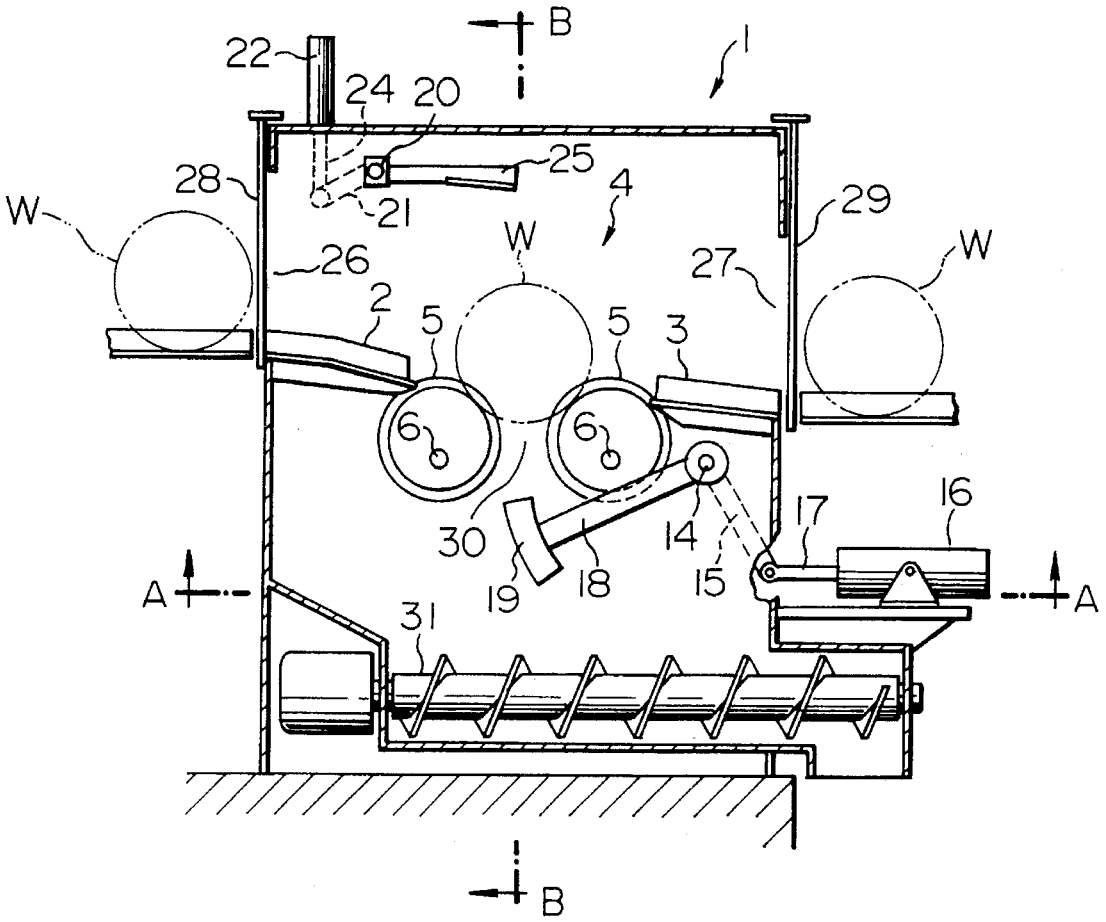
FIG. 1 is a transverse sectional view showing a polishing and cleaning chamber in a shot blasting apparatus according to the present invention.
Figure 2:
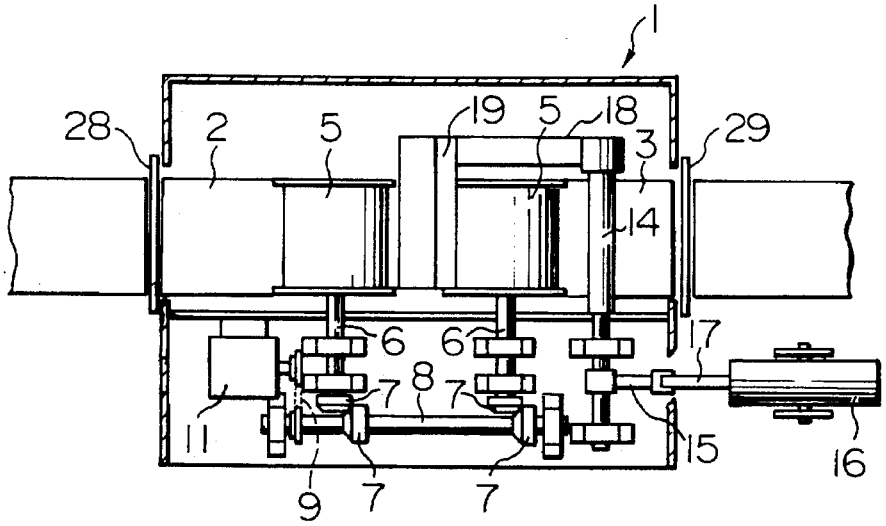
FIG. 2 is a sectional view along the line A—A in FIG. 1.
Figure 3:
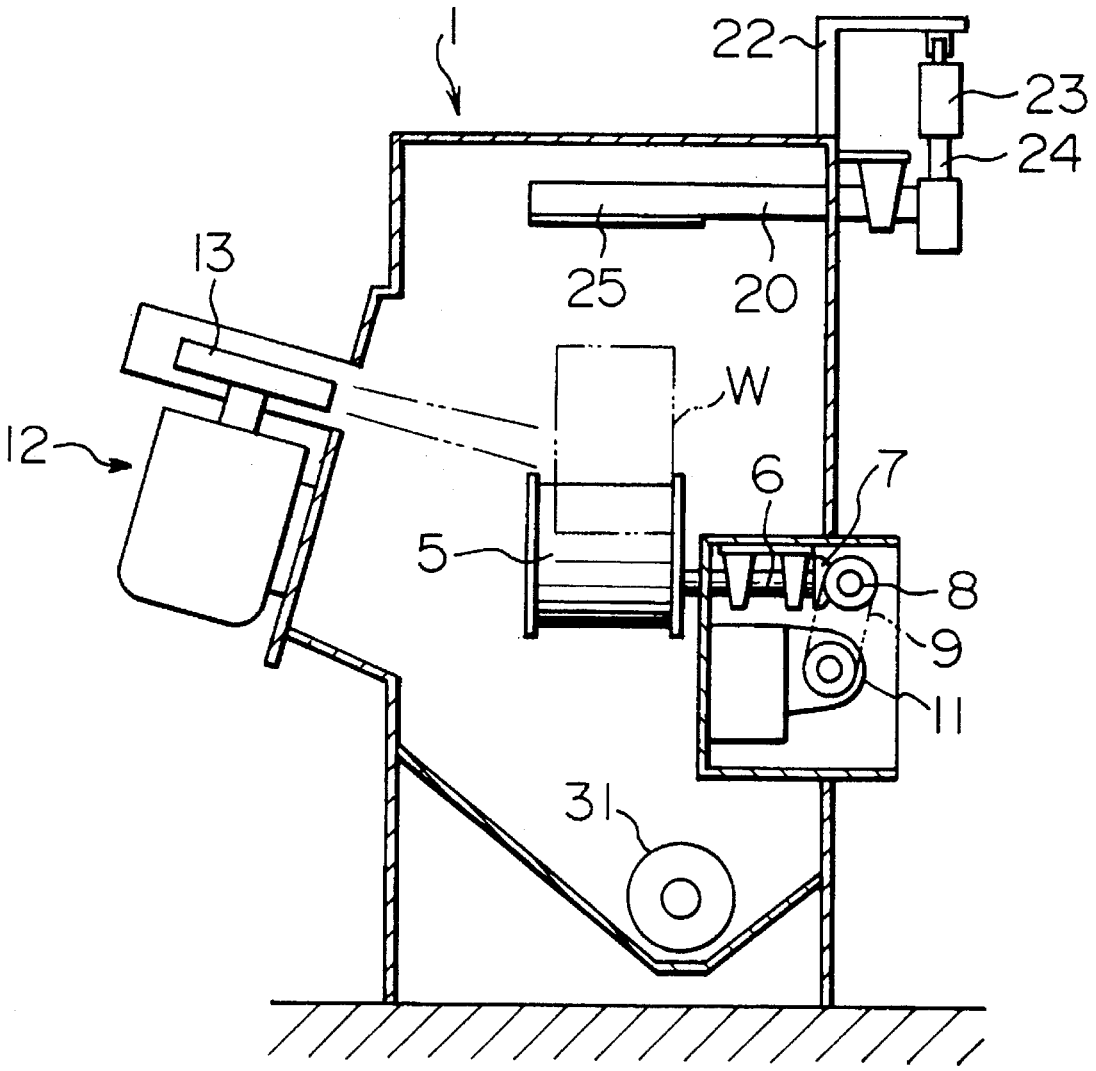
FIG. 3 is a sectional view along the line B—B in FIG. 1.

Explanation will be made of an embodiment of the present invention with reference to FIGS. 1 to 3.

In a polishing and cleaning chamber 1 of a shot blasting apparatus in this embodiment, a transfer path 4 composed of a inlet guide way 2 and an outlet guide way 3 is provided, and a pair of eccentric rollers 5, 5 are arranged in series between the inlet guide way 2 and the outlet guide way 3 with a predetermined gap 30 therebetween, having their rotary shafts 6, 6 which are orthogonal to the transfer path 4. The rotary shafts 6, 6 of the eccentric rollers 5, 5 are coupled to a drive shaft 8 through the intermediary of two pairs of bevel gears 7, 7 while the drive shaft 8 is coupled to the drive shaft of a motor 11 through the intermediary of a chain 9. Accordingly, when the motor 11 is driven, the eccentric rollers 5, 5 are rotated in a vertical plane and in one and the same direction, being synchronized with each other so that an aluminum wheel W set on the eccentric rollers 5, 5 is rotated and revolved. A centrifugal shot ejector 12 for ejecting shots onto one rotating side of the aluminum wheel W which is rotated and revolved being set on the eccentric rollers 5, 5 is mounted to one side of the polishing and cleaning chamber 1. This centrifugal shot ejector 12 includes a shot ejecting wheel 13 which is arranged so as to be rotated in a horizontal plane, and accordingly, its shot ejection zone is band-like, extending horizontally.

Below the outlet guide way 3, a shaft 14 is laid in parallel with the rotary shafts 6, 6 of the eccentric rollers 5, 5 so as to rotate in a vertical plane. A first arm 15 is mounted on the shaft 14, near to one end of the latter, having its distal end which is pinned to the forward end of a piston rod 17 in a cylinder 16 that is laid orthogonal to the above-mentioned shaft 14. A second arm 18 is attached to the other end of the shaft 14. A kick-out bracket 19 is fitted to the distal end of the second arm 18. Thus, the bracket 19 passes through the gap 30 between the eccentric rollers 5, 5 in association with the extension and retraction of the piston rod 17 while ascends and descends along a circular arc having a radius equal to the length of the second arm 18 with the shaft 14 as a center.

Above the inlet guide way 2, a shaft 20 is laid in parallel with the rotary shafts 6, 6 of the eccentric rollers 5, 5 so as to rotate in a vertical plane. An arm 21 is attached to one end of the shaft 20, having its distal end is pinned to the forward end of a piston rod 24 in a cylinder 23 which is mounted on the upper part of the polishing and cleaning chamber 1 by means of a bracket 22, being directed downward. The shaft 20 is attached at the other end thereof with a stopper 25 which is rotated around the shaft 20 as a center in a vertical plane, being associated with the extension and retraction of the piston rod 24. Further, the polishing and cleaning chamber 1 is formed therein with an inlet opening 26 and an outlet opening 27 which are opened and closed by doors 28, 29. Further, a screw conveyer 31 for discharging ejected shot and dust from the chamber 1 is laid at the bottom part of the chamber 1.

Next, explanation will be made hereinbelow of the operation of the above-mentioned apparatus in the case of polishing and cleaning a rotating side of an aluminum wheel with reference to FIGS. 4 to 8.

Figure 4:
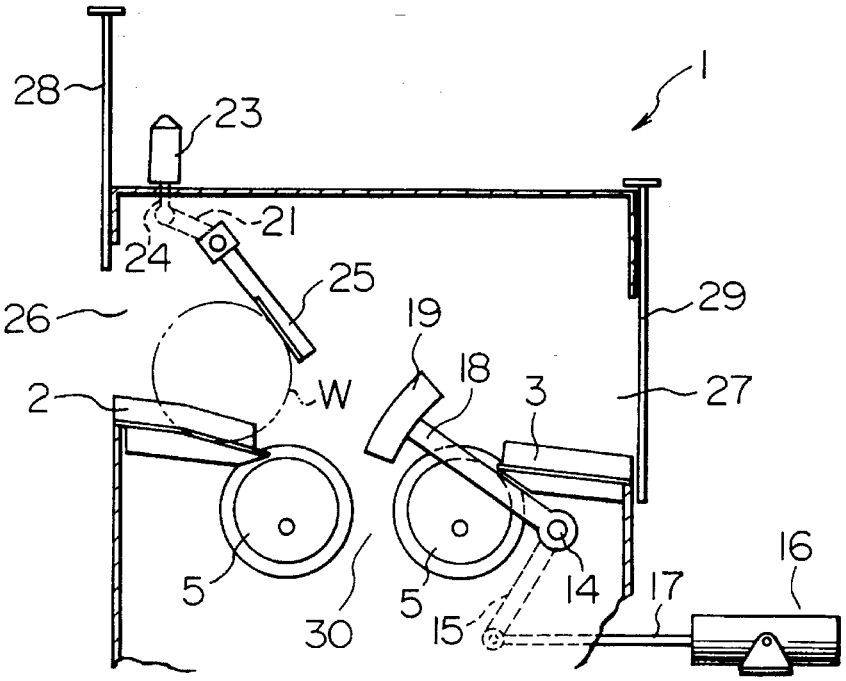
FIGS. 4 to 6 and 8 are schematic views for explaining a process of rolling and transferring of an aluminum wheel.
Figure 5:
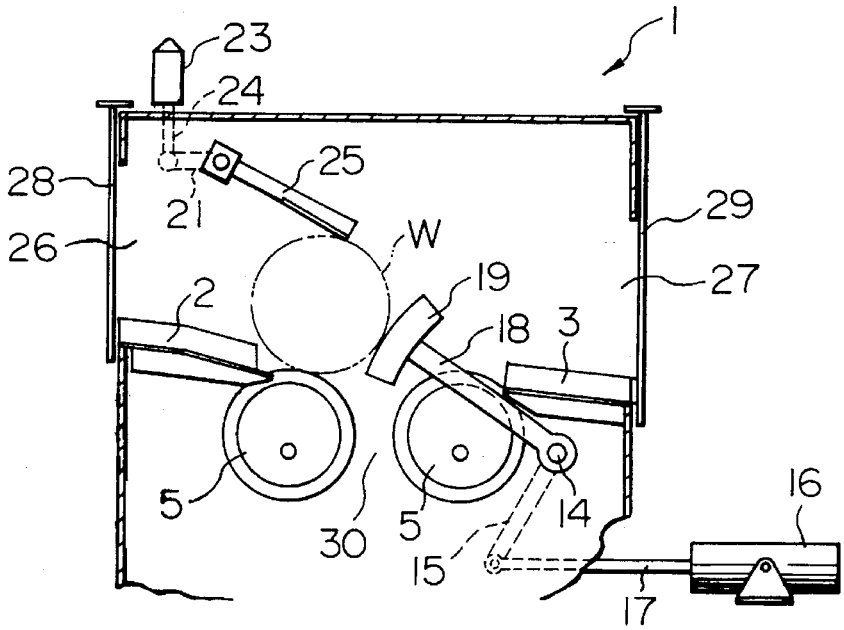
Figure 6:
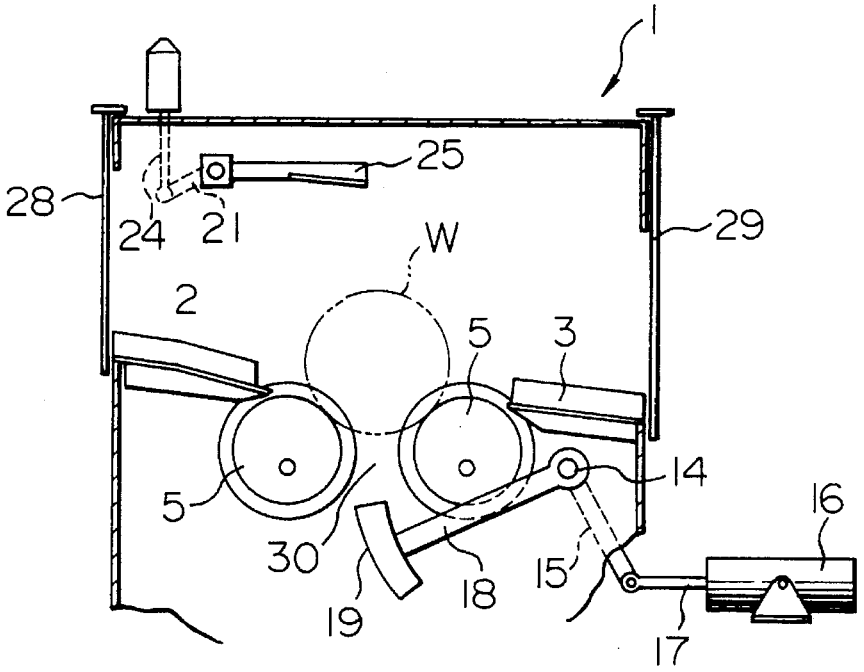
Figure 7:
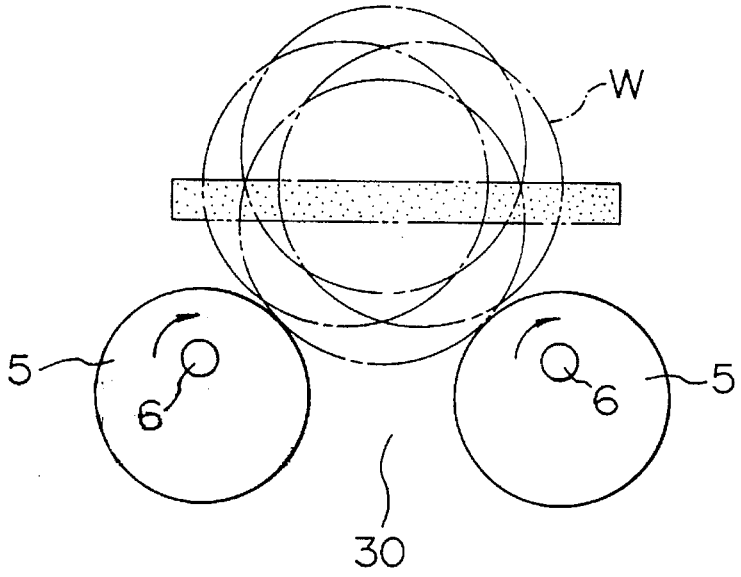
FIG. 7 is a schematic view for explaining a shot ejecting condition, with respect to the motion of the aluminum wheel on eccentric rollers.
Figure 8:
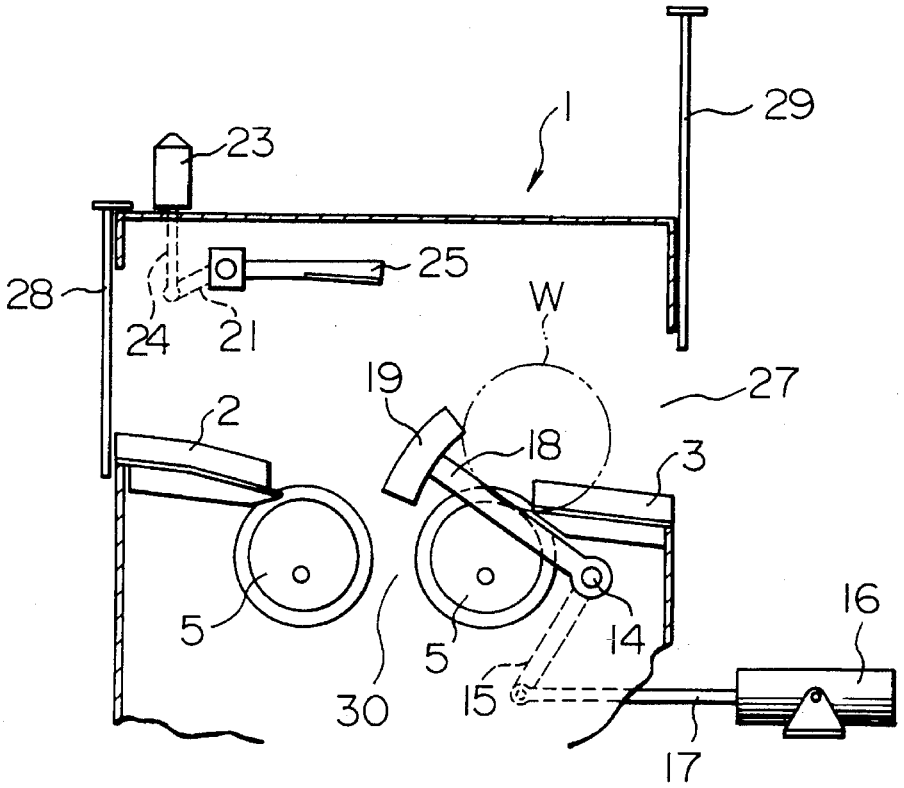
Figure 9:
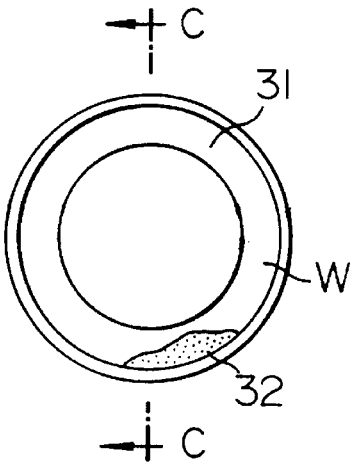
FIG. 9 is a front view illustrating an aluminum wheel on polishing and cleaning.
Figure 10:
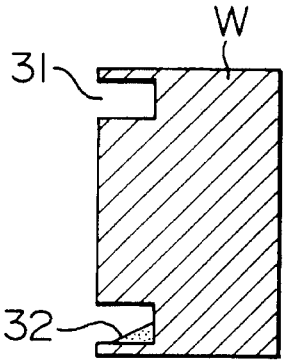
FIG. 10 is a sectional view along the line C—C in FIG. 9.

First, referring to FIG. 4 which shows such a condition that the piston rod 17 is extended from the cylinder 16 so as to raise the kick-out bracket 19 up to its upper limit position while the piston rod 24 is retracted into the cylinder 23 so as to lower the stopper 25 down to its lower limit position, when an aluminum wheel W is introduced into the polishing and cleaning chamber 1 through the inlet opening 26 with the door 28 being opened, the aluminum wheel W rolls under gravitation on the inlet guide way 2 and then abuts against the stopper 25. Accordingly, the aluminum wheel W is stopped once on the inlet guide way 2. Second, when the piston rod 24 is extended so as to raise the stopper 25, the aluminum wheels W rolls down on a slope of the inlet guide way 2 and abuts against the front surface of the kick-out bracket 19 so that the aluminum wheel W is once stopped on the eccentric roller 5 on the side near to the inlet guide way 2 (refer to FIG. 5). Third, when the piston rod 17 is retracted so as to lower the kick-out bracket 19, the aluminum wheel W is set on both eccentric rollers 5, 5 (refer to FIG. 6). Fourth, after the door 28 for the inlet opening 26 is closed, the motor 11 is driven to rotate the both eccentric rollers 5, 5 in one and the same direction, being synchronized with each other, and accordingly, the aluminum wheel W is rotated and revolved on both eccentric rollers 5, 5. Fifth, under the above-mentioned condition, the shots are ejected from the centrifugal shot ejector 12 so as to polish and clean one rotating side of the aluminum wheel W (Refer to FIG. 7). It is noted that the zone of shot ejection in this case is band-like, extending horizontally. Further, the shot ejection zone is adjusted so that it does not cover the lower part of an annular groove 31 formed on the rotating side of the aluminum wheel W (refer to FIGS. 9 and 10), and accordingly, no detrimental affection is exerted upon the polishing and cleaning effect even though a large number of shots 32 remain in the lower part of the annular groove 31. After completion of the polishing and cleaning operation, sixth, the door 29 for the outlet opening 27 is opened, and then the piston 17 is extended from the cylinder 16 so as to raise the kick-out bracket 19. As a result, the aluminum wheel W set on the eccentric rollers 5, 5 is driven onto the outlet guide way 3 by the rear surface part of the kick-out bracket 19, and accordingly, the aluminum wheel W rolls down on a slope of the outlet guide way 3. Thus, the aluminum wheel W is discharged from the polishing and cleaning chamber 1 (Refer to FIG. 8).

The above-mentioned process as one cycle is repeated so as to successively polish and clean several aluminum wheels.

According to the invention, as mentioned above, the rolling speed of an aluminum wheel is controlled by the stopper and the kick-out bracket when the aluminum wheel is to be set on the eccentric rollers in the polishing and cleaning chamber, and accordingly, there is no such a risk that the aluminum wheel falls down. Further, since shots are ejected from the centrifugal shot ejector in a band-like zone which horizontally extends and which is adjusted so that it does not cover the lower part of an annular groove 31 formed on one side of the aluminum wheel when the aluminum wheel is polished and cleaned by the centrifugal shot ejector, a uniform polishing and cleaning result can be obtained with no detrimental affection being exerted upon the polishing and cleaning effect even though ejected shots remains by a large quantity in this lower part of the annular groove.

Although explanation has been made in the above-mentioned embodiment such that only one rotating side of an aluminum wheel is polished and cleaned at one time, two centrifugal shot ejectors can be used being opposed to each other so that both rotating side surfaces of an aluminum wheel are polished and cleaned simultaneously.

Further, a centrifugal shot ejector can be also mounted to the ceiling part of the polishing and cleaning chamber, being directed downward in order to simultaneously polish and clean the circumference of the aluminum wheel in addition to the rotating sides thereof.

What is claimed is:

1. A shot blasting apparatus for polishing and cleaning a wheel, comprising:

a polishing and cleaning chamber with a closeable inlet opening for introducing a wheel to be polished and cleaned into said chamber, and a closeable outlet opening for delivering a polished and cleaned wheel from said chamber;

first and second eccentrically mounted rollers in said chamber, and means for rotating said rollers so that a wheel set on said rollers rotates and revolves in a vertical plane, with said rollers defining a gap therebetween;

a transfer path including an inlet guide way along which a wheel to be polished and cleaned rolls from said inlet opening to said first roller, and an outlet guide way along which a polished and cleaned wheel rolls from said second roller to said outlet opening;

a centrifugal shot ejecting means in said chamber for ejecting shots onto a wheel set upon said rollers;

a retractable stopper within said chamber, and means for causing said stopper to approach said inlet guide way so that said stopper engages a wheel to be polished and cleaned and stops this wheel on said inlet guide way within said chamber, and then for causing said stopper to retreat from said inlet guide way so that said stopper allows said wheel to roll down said inlet guide way at a controlled rolling speed; and a bracket positioned within said chamber, and means for ascending and descending said bracket through said gap to a first position above said rollers and a second position beneath said rollers, respectively, so that a wheel is stopped by said bracket on said first roller when said bracket ascends to said first position, this wheel is released by the bracket and rolls onto said rollers as said bracket descends towards said second position, and then this wheel is kicked out, after it has been polished and cleaned, by said bracket as said bracket ascends again towards said first position such that said wheel rolls on said outlet guide way.

2. The shot blasting apparatus as set forth in claim 1, wherein said wheel is formed on at least one of its sides with an annular groove, and said centrifugal shot ejecting means includes a shot ejecting wheel which is rotated in a horizontal plane so that shots are ejected in a band-like zone which extends horizontally, in order to polish and clean said at least one of the sides of the wheel.

3. The shot blasting apparatus as set forth in claim 1, wherein said bracket is attached to one end of an arm which is mounted on a shaft laid in said polishing and cleaning chamber, said means for ascending and descending said bracket pivotally moving said arm about a longitudinal axis of said shaft.

4. The shot blasting apparatus as set forth in claim 3, wherein said means for ascending and descending said bracket includes a cylinder located outside of said polishing and cleaning chamber, a piston rod extending from said cylinder into said polishing and cleaning chamber and having its free end attached to a first end of another arm, with a second end of said another arm coupled to said shaft.

5. The shot blasting apparatus as set forth in claim 1, wherein said stopper is mounted on a shaft positioned above said inlet guide way within said polishing and cleaning chamber, and said means for causing said stopper to approach and retreat with respect to said inlet guide way pivotally moves said stopper about a longitudinal axis of said shaft.

6. The shot blasting apparatus as set forth in claim 1, wherein said first and second eccentrically mounted rollers have respective rotary shafts, said means for rotating said rollers includes a drive shaft, two pairs of bevel gears coupling said rotary shafts to said drive shaft, and a motor for rotating said drive shaft such that said first and second eccentrically mounted rollers are rotated in one and the same direction, being synchronized with each other.

7. The shot blasting apparatus as set forth in claim 6, wherein said rotary shafts are orthogonal to said transfer path, and further comprising a shaft in parallel with said rotary shafts within said polishing and cleaning chamber, and an arm mounted on said shaft and having one end to which said bracket is fixed.

8. The shot blasting apparatus as set forth in claim 6, wherein said rotary shafts of said first and second eccentrically mounted rollers are laid in one and the same horizontal plane, and said inlet guide way is inclined downward from said inlet opening to said first eccentrically mounted roller while said outlet guide way is inclined downward from said second eccentrically mounted roller to said outlet opening.

9. The shot blasting apparatus as set forth in claim 1, wherein said bracket is attached to one end of an arm mounted on a first shaft laid in said polishing and cleaning chamber, said means for ascending and descending said bracket pivotally moving said arm about a longitudinal axis of said first shaft and said stopper is mounted on a second shaft positioned above said inlet guide way within said polishing and cleaning chamber, and said means for causing said stopper to approach and retreat with respect to said inlet guide way pivotally moves said stopper about a longitudinal axis of said second shaft.

10. The shot blasting apparatus as set forth in claim 1, wherein said centrifugal shot ejecting means is positioned to eject shots onto a side and a circumference of said wheel.

* * * * *